US006265693B1

(12) United States Patent
Okada

(10) Patent No.: US 6,265,693 B1
(45) Date of Patent: Jul. 24, 2001

(54) IMAGE RECORDING APPARATUS

(75) Inventor: Koichi Okada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/388,526

(22) Filed: Sep. 2, 1999

(30) Foreign Application Priority Data

Sep. 21, 1998 (JP) ..... 10-266597

(51) Int. Cl.[7] ..... H05B 1/00

(52) U.S. Cl. ..... 219/216; 399/279; 430/350; 430/353; 347/154

(58) Field of Search ..... 219/216, 469; 399/279, 286; 430/350, 353; 347/154

(56) References Cited

U.S. PATENT DOCUMENTS

| | | | |
|---|---|---|---|
| 2,861,056 | 11/1958 | Minsk et al. | 260/78.3 |
| 3,206,312 | 9/1965 | Sterman et al. | 96/87 |
| 3,428,451 | 2/1969 | Trevoy et al. | 96/1 |
| 5,380,644 | 1/1995 | Yonkoski et al. | 430/617 |
| 6,077,649 * | 6/2000 | Torisawa | 430/353 |

FOREIGN PATENT DOCUMENTS

| | | | |
|---|---|---|---|
| 60-244945 | 12/1985 | (JP) | G03C/1/06 |
| 61-20033 | 1/1986 | (JP) | G03C/1/82 |
| 62-170950 | 7/1987 | (JP) | G03C/1/00 |
| 63-188135 | 8/1988 | (JP) | G03C/7/00 |
| 6-301140 | 10/1994 | (JP) | G03C/1/498 |

* cited by examiner

*Primary Examiner*—Teresa Walberg
*Assistant Examiner*—Shawntina Fuqua
(74) *Attorney, Agent, or Firm*—Sughrue, Mion, Zinn, Macpeak & Seas, PLLC

(57) ABSTRACT

An image recording apparatus comprises a heat-developing section for heat-developing a latent image formed on a photo/heat-sensitive material sheet in which antistatic agent is added, and conveying rollers made of resin for conveying the photo/heat-sensitive material sheet along a sheet feeding path including at least the heat-developing section.

1 Claim, 2 Drawing Sheets

IMAGE RECORDING APPARATUS

BACKGROUND OF THE INVENTION

The present invention relates to a heat-development recording apparatus and heat sensitization which is performed in a film conveying apparatus for conveying a film, such as a heat-development photosensitive material, and more particularly to an antistatic technique for use when a film, such as a heat-development photosensitive material, is conveyed.

As an image recording apparatus for recording a medical image for use in a digital radiography system, a CT, an MR or the like, a wet system has been known which obtains a reproduced image by performing a wet process after a process for photographing or recording an image on a silver-salt photosensitive material has been performed.

In recent years, a recording apparatus has attracted attention which employs a dry system in which the wet process is not performed and which uses a heat-development photosensitive material.

FIG. 3 is a block diagram showing a related heat-development recording apparatus.

The foregoing apparatus is an apparatus for performing all of recording of a latent image on a recording material, development of the latent image and transference of the image in a dry state. Referring to FIG. 3, a heat-development photosensitive material which is a recording material is, in an exposure section 4, irradiated (scanned) with a laser beam modulated by a laser modulation section 3 in accordance with image data 1 so that a latent image is formed. Then, the exposed heat-development photosensitive material is, in a heat-development section 5, brought into contact with a heating means so that heat-development is performed. As a result, an image is obtained.

When the above-mentioned sequential heat-development process is performed, the photosensitive material is, while being nipped by conveying rollers, conveyed from a magazine loaded into the heat-development recording apparatus to the exposure section 4 after which the photosensitive material is conveyed from the exposure section 4 to the heat-development section 5. During the conveyance, an emulsion binder of a conventional wet-type silver-salt film containing water in a large quantity has inhibited easy electrification.

On the other hand, a dry silver material for use in a method in which all of the processes for obtaining an image are performed in a dry state must maintain the hardness of the surface of the dry silver material. Therefore, an emulsion binding having a low water content must be employed, causing undesirable electrification to sometimes occur during conveyance or in a manufacturing process.

If the electrification of the photosensitive material occurs, adhesion of dust or the like easily takes place. It leads to a fact that an irregular image occurs. What is worse, a plurality of the photosensitive materials sometimes adsorb one another. In the foregoing case, introduction of the sheet material encounters a problem, causing a malfunction to occur.

SUMMARY OF THE INVENTION

It is therefore an object of the present invention is to provide an image recording apparatus which is capable of preventing electrification of a film, which is a heat-development photosensitive material or the like, preventing a malfunction or the like during the heat-development process and improving conveyance easiness of the sheet and which can be manufactured at a low cost.

In order to achieve the foregoing object, according to the present invention, there is provided an image recording apparatus comprising: a heat-developing section for heat-developing a latent image formed on a photo/heat-sensitive material sheet in which an antistatic agent is added; and conveying rollers made of resin for conveying the photo/heat-sensitive material sheet along a sheet feeding path including at least the heat-developing section.

The foregoing structure is arranged such that the antistatic agent is added to the film, such as the heat-development photosensitive material. Therefore, electrification during the manufacturing process and the conveying process can be prevented. Thus, any antistatic brushes and adhesive rollers are not required. Moreover, use of the resin roller for conveying the heat-development photosensitive material sheet enables the manufacturing cost to be reduced.

DETAILED DESCRIPTION OF THE PREFERRED EMBODIMENTS

Figure 1:
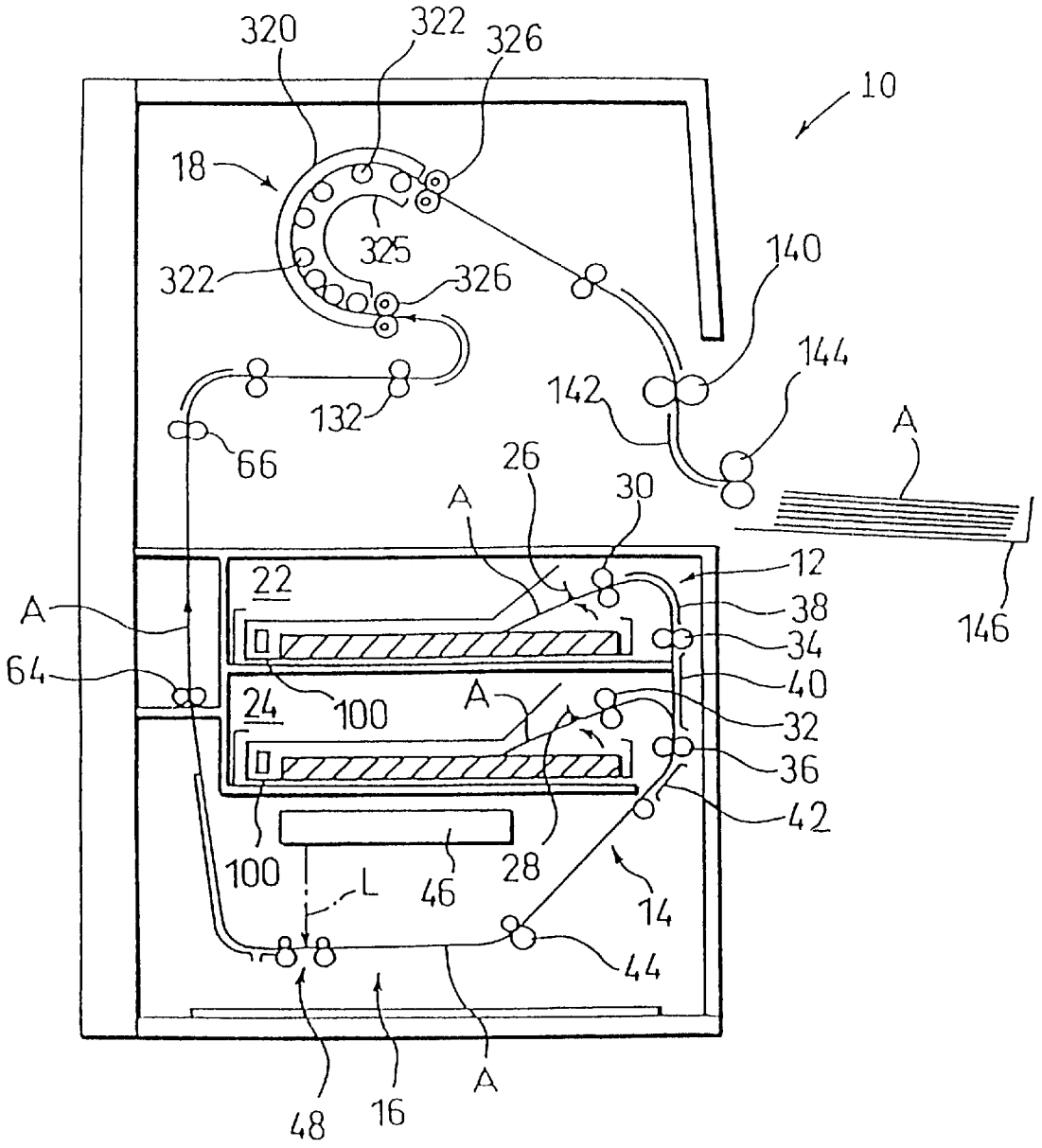
FIG. 1 is a schematic section view showing a heat-development recording apparatus according to an embodiment of the present invention.
Figure 2:
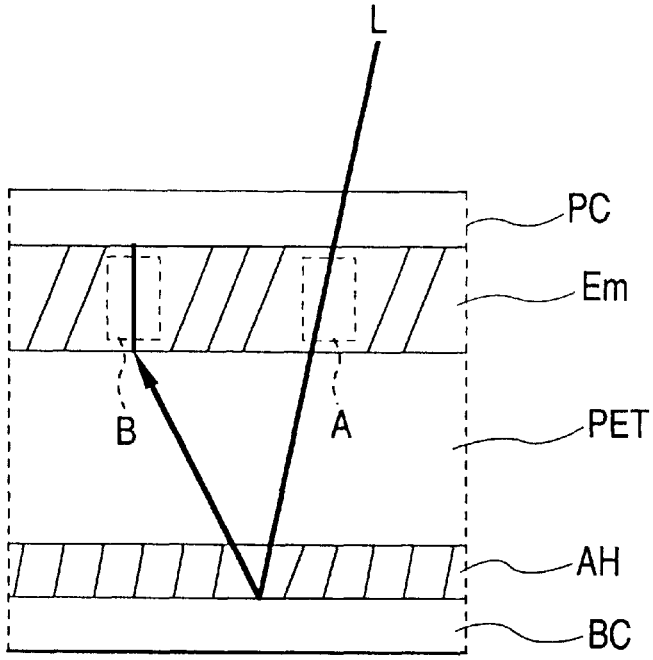
FIG. 2 is a section view showing a heat-development photosensitive material.
Figure 3:
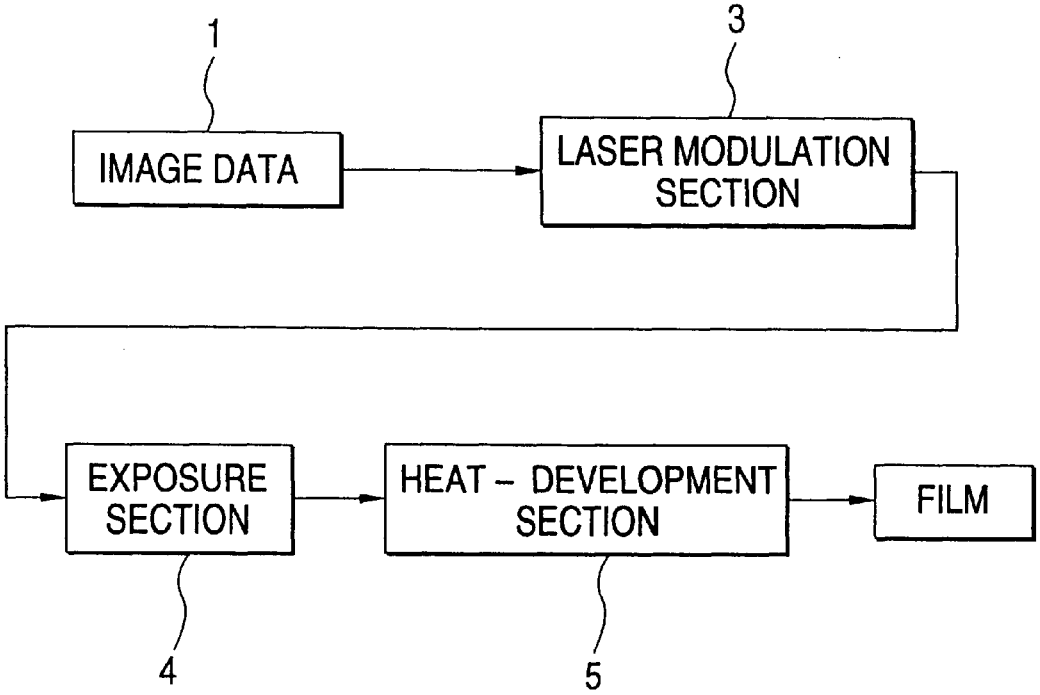
FIG. 3 is a block diagram showing a configuration of a related heat-development recording apparatus.

Referring to the drawings, an embodiment of the present invention will now be described. FIG. 1 is a schematic section view showing a heat-development recording apparatus according to one embodiment of the present invention. FIG. 2 is a section view showing a heat-development photosensitive material.

Referring to FIG. 1, the structure of the heat-development recording apparatus will now be described. An image forming apparatus 10 is an apparatus arranged to use a heat-development photosensitive material (hereinafter called a "recording material sheet A") which does not require the wet development process. Moreover, scanning exposure using laser beam L is performed to expose the recording material sheet A to correspond to a required image so that a latent image is formed. Then, heat-development is performed so that a visible image is obtained.

The image forming apparatus 10 comprises a recording-material supply section 12, a width aligning section 14, an image exposure section 16 and a heat-development section 18 disposed in this order in a direction in which the recording material sheet A is conveyed. Thus, conveying rollers indicated with circles in the drawing convey the recording material sheet A. Therefore, the passage formed by the conveying rollers can be considered as a film conveying apparatus according to the present invention.

The recording-material supply section 12 has two sections having inside portions 22 and 24 to permit selective use of the recording material sheets A (for example, B4-size sheets or half-cut sheets) set in the foregoing sections through a magazine 100. The recording material sheet A is a recording material on which an image is recorded (exposed) by the laser beam L and which is developed with heat to develop color. In accordance with a print command, an uppermost recording material sheet A in the magazine 100 selected by suction cups 26 and 28 structured for each sheet is taken out in a state in which the cover of the magazine is opened Then, the recording material sheet A is guided by paired supply rollers 30 and 32, paired conveying rollers 34 and 36 and conveying guides 38, 40 and 42 disposed downstream in the conveying direction so as to be conveyed to the width aligning section 14.

The width aligning section 14 aligns the position of the recording material sheet A with a direction (hereinafter called a "widthwise direction") perpendicular to the conveying direction. In the downstream image exposure section 16, the width aligning section 14 performs alignment of the recording material sheet A in the main scanning direction, that is, so-called side regist. Then, a conveying roller pair 44 conveys the recording material sheet A to the downstream image exposure section 16. The downstream image exposure section 16 uses a light beam to expose the recording material sheet A to correspond to the image, the image exposure section 16 incorporating an exposing unit 46 and a sub-scan conveying means 48.

Then, the recording material sheet A caused to have the latent image formed by the image exposure section 16 is conveyed to the heat-development section 18 by conveying roller pairs 64, 66 and 132. The heat-development section 18 is a section for heating the recording material sheet A to perform the heat-development to convert the latent image into a visible image. A plate heater 320 accommodated in the heat-development section 18 includes a heating member which is a plate-like heating member including a heating member, such as a nichrome wire, which is laid flatly. Thus, the development temperature for the recording material sheet A is maintained. As shown in the drawing, the plate heater 320 projects upwards. Moreover, there are provided a supply roller 326 serving as a conveying means for relatively moving the recording material sheet A with respect to the plate heater 320 while making contact the recording material sheet A with the surface of the plate heater 320; and a pressing roller 322 which transmits heat from the plate heater 320 to the recording material sheet A and disposed adjacent to the lower surface of the plate heater 320.

Moreover, a heat insulating cover 325 for maintaining the temperature is disposed opposite to the plate heater 320 of the pressing roller 322.

As a result of the foregoing structure, the recording material sheet A passes through a space between the pressing roller 322 and the plate heater 320 by dint of the conveying rotations of the paired roller 326. Then, the heat treatment is performed so that the recording material sheet A is developed with heat. Then, the exposure process is performed so that the latent image recorded by the exposure is converted into a visible image. Since the conveyance is performed such that the leading end of the recording material sheet A is pressed against the plate heater 320, buckling of the recording material sheet A can be prevented.

Although the plate heater has been described, the present invention is not limited thereto. A method which is other than heat-development method, for example, a combination of a heat drum and a belt member may, of course, be employed.

The recording material sheet A discharged from the heat-development section 18 is, by a conveying roller pair 140, guided to a guide plate 142. Then, the recording material sheets A are accumulated in a tray 146 through paired discharge rollers 144.

In the image recording apparatus 10 shown in FIG. 1, any antistatic brushes and adhesive rollers are not employed in the passage for the recording material sheet A. All of the conveying rollers are resin rollers. That is, the low-cost resin rollers and rubber rollers are employed so that a significant sheet conveyance characteristic is realized and the manufacturing cost can be reduced.

The resin rollers may be made of rubber or the like including phenol resin, polyacetal (POM), thermoplastic elastomer, ABS and polyurethane.

The reason why the low-cost resin rollers or the rubber rollers can be employed lies in that electrification does not easily occur because an antistatic agent (an AS agent) is added to the recording material sheet A. The antistatic agent and the recording material sheet A will now be described.

(1) Antistatic Agent Using Surface Active Agent:

Any one of a nonion type agent, an anion type agent, a cation type agent and a fluorine type agent may be employed. Specifically, the following materials are exemplified: fluorine-type polymer surface active agents disclosed in Japanese Patent Publication No. 62-170950A and U.S. Pat. No. 5,380,644; fluorine-type surface active agent disclosed in Japanese Patent Publication Nos. 60-244945A and 63-188135A; and surface active agents, such as polyalkyleneoxide and anion type surface active agent disclosed in Japanese Patent Publication No. 6-301140A.

(2) Antistatic Agent having an antistatic agent effect or an effect of conductivity:

For example, any one of the following materials may be employed: soluble salt (for example, chlorides or nitrates); an evaporated metal layer; and ionic polymers disclosed in U.S. Pat. No. 2,861,056 and U.S. Pat. No. 3,206,312.

Moreover, a layer containing insoluble inorganic salt disclosed in U.S. Pat. No. 3,428,451 and Japanese Patent Publication No. 61-20033A may be provided.

The antistatic agent is added to a PC layer (a surface protective layer) of the recording material sheet A which will now be described.

The layer structure of the heat-development photosensitive material which is the recording material sheet A for use in the embodiment of the present invention will now be described.

FIG. 2 is a cross sectional view showing the heat-development photosensitive material. Referring to FIG. 2, the material incorporates, when viewed from the surface on which the laser beam is made incident (from the upper portion of the drawing), a PC layer which is a surface protective layer for protecting an image forming layer and preventing adhesion; an Em (emulsion) layer for forming an image; a PET layer which is a support layer and which is usually made of PET; and a back coating (BC) layer (and an AH (antihalation) layer in some cases).

The Em layer is an image forming layer formed on the surface of the support layer on which the laser beam L is made incident and containing a binder composed of latex at a ratio of 50% or higher and a reducing agent which is organic silver salt. When the image forming layer is exposed to incident laser beam L, a photocatalyst, such as photosensitive silver halide, forms a core for a latent image. When the core of the latent image is heated, the action of the reducing agent moves silver of the ionized organic silver salt so as to be bonded with the photosensitive silver halide and formed into crystal silver with which an image is formed. As the organic silver salt, silver salt of an organic acid, preferably silver salt of long-chain fatty carboxylic acid having 10 to 30 carbon atoms and organic or inorganic silver salt, the ligant of which has a stability factor coefficient of complex of 4.0 to 10.0 are exemplified. Specifically, the following materials are exemplified: silver salt of behenic acid, silver salt of arachidic acid, silver stearate, silver olerate, silver laurate, silver caproate, silver myristate, silver palmitate, silver maleate, silver fumarate, silver tartrate, silver linoleate, silver butyrate and silver camphorate. The image forming layer of the recording material contains a material, for example, photosensitive silver halide (hereinafter called "silver halide") which is converted into a photocatalyst after it has been exposed to light.

The image forming layer of the recording material or another layer on the same surface of the image forming layer may contain an additive which is known as a tone adjuster in a preferred quantity of 0.1 to 50 mol % with respect to one mol of silver to raise the optical density. Note that the tone adjuster may be a precursor induced to have an effective function only when the development process is performed. The tone adjuster may be any one of a variety of known tone adjusters for use in the recording material. Specifically, the following materials are exemplified: a phthalimide compound, such as phthalimide or N-hydroyphthalimide; cyclic imide, such as succinimide, pyrazoline-5-on; naphthalic imide, such as N-hydroxy-1, 8-naphthalic imide; cobalt complex, such as cobalt hexamine trifluoroacetate; mercaptan, such as 3-mercapto-1, 2, 4-triazole or 2, 4-dimercaptopyrimidine; phthalazinone derivative, such as 4-(1-naphtyl) phthalazinone; and its metal salt. The foregoing tone adjuster is added to the solution, which must be applied, as solution, powder or dispersed solid particles.

The sensitizing coloring matter must be capable of spectrosensitizing silver halide in a required wavelength region when the sensitizing coloring matter has been adsorbed to silver halide particles. To add the sensitizing color matter to the silver halide emulsion, it may directly be dispersed in the emulsion or it may be dissolved in single or a mixed solution of water, methanol, ethanol, N, N-dimethylformamide or the like, followed by adding the solution to the emulsion.

The surface protective PC layer is formed by an adhesion preventive material exemplified by wax, silica particles, elastomer-type block copolymer containing styrene (styrene-butadiene-styrene or the like), cellulose acetate, cellulose acetate butylate and cellulose propionate.

When the halation preventive dye is employed, any compound capable of satisfying the following requirement may be employed: the dye must be cable of performing required absorption in the wavelength and; the absorption must sufficiently be restrained in the visible region after the process has been completed; and a preferred absorbance spectrum shape of the antihaltion layer AH can be obtained. Although the following materials are exemplified, the material is not limited to the following materials. As single dye, compounds disclosed in Japanese Patent Publication Nos. 7-11432A and 7-13295A are exemplified. As dye which performs decoloration by carrying out processes, compounds disclosed in Japanese Patent Publication Nos. 52-139136A and 7-199409A are exemplified. It is preferable that the foregoing recording material has the image forming layer on either surface of the support member and a back layer on another surface.

To improve conveyance easiness, a matting agent may be added to the back BC layer. In general, the matting agent is in the form of particles of organic or inorganic compound which is dissoluble in water. The preferred organic compound is exemplified by water dissoluble vinyl polymer, such as polymethylacrylate, methyl cellulose, carboxy starch and carboxy nitrophenyl starch. The preferred inorganic compound is exemplified by silicon dioxide, titanium dioxide, magnesium dioxide, aluminum oxide and barium sulfate.

The binder for forming the back layer may be any one of a variety of colorless, transparent or semitransparent resins. The resin is exemplified by gelatin, arabic rubber, polovinyl alcohol, hydroxyethyl cellulose, cellulose acetate, cellulose acetate butylate, casein, starch, poly (metha) acrylate, polymethylmethacrylate and polyvinyl chloride.

It is preferable that the back layer is a layer, the maximum absorption is 0.3 to 2 in a required wavelength range. If necessary, the halation preventive dye for use in the foregoing antihalation layer may be added to the back layer.

As for the recording material sheet A, the following methods and recording materials for use in the foregoing methods are exemplified in the present invention as well as the structure according to the foregoing embodiment.

(1) A method in which a photosensitive material exposed to correspond to an image is laminated with an image receiving material, and then the laminate is heated (and applied with pressure, if necessary) so that an image corresponding to a latent image formed on the photosensitive material owning to the exposure is transferred to an image receiving material (for example, methods disclosed in Japanese Patent Publication Nos. 5-113629A, 8-42803A, 9-61978A, 9-152705A, 9-258404A, 10-71740A, 10-254111A and 11-84610A).

(2) A method with which a photosensitive material exposed to correspond to an image is laminated with a material, which must be processed, and then the laminate is heated so that an image corresponding to a latent image formed on the photosensitive material owning to the exposure is formed on the photosensitive material (for example, methods disclosed in Japanese Patent Publication Nos. 9-274295A and 11-212230A).

(3) A method with which a photosensitive material having a photosensitive layer in which silver halide serving as a photocatalyst, silver salt serving as an image forming substance and reducing agent for silver ions are dispersed in a binder is exposed to correspond to an image after which the photosensitive material is heated to a predetermined temperature so that a latent image formed owing to the exposure is formed into a visible image (for example, methods disclosed by B. Shely in "Thermally Processed Silver Systems" (Imaging Processes and Materials) Neblette, 8th edition, Sturge, V. Walworth and A shepp, pp. 2, 1996, Research Disclosure 17029 (1978), EP803764A1, EP803765A1 and Japanese Patent Publication No. 8-211521A).

(4) A method using a photosensitive and thermosensitive recording material and arranged such that a photosensitive and thermosensitive recording layer incorporates a recording material which has electron releasing colorless dye capsulated in a heat response microcapsule, a compound having, in the same molecule thereof, an electron receiving portion and a polymerizable vinyl monomer portion and a light polymerization initiator disposed on the outside of the microcapsule (for example, a method disclosed in Japanese Patent Publication No. 4-249251A). As an alternative to this, a method in which the photosensitive and thermosensitive recording layer incorporates a recording material having electron releasing colorless dye capsulated in a heat response microcapsule and an electron receiving compound, polymerizable vinyl monomer and a light polymerization initiator disposed on the outside of the microcapsule (for example, a method disclosed in Japanese Patent Publication No. 4-211252A).

In this specification, the photosensitive materials and recording materials for use in the foregoing dry development method are collectively called "heat-development photosensitive materials". Note that water in a small quantity may be used in the foregoing dry development methods (1) and (2) in order to enhance development and image formation.

As described above, according to the present invention, the antistatic agent is added to the recording material sheet, such as the heat-development photosensitive material. Therefore, electrification occurring during the manufacturing process and conveyance can be prevented. As a result, the heat-development recording apparatus for recording an image on a film, such as the heat-development photosensitive material, does not require any antistatic brushes and adhesive rollers for removing dust.

As a result, the heat-development recording apparatus is permitted to incorporate low-cost resin rollers. Thus, the materials of the rollers may be selected from a variety of materials and low-cost materials. Moreover, use of the characteristics of the resin enables the conveyance easiness to be improved.

Since fogging of a film, occurrence of noise and adhesion of a plurality of sheets caused from adhesion of dust and discharge can be prevented, a malfunction can be prevented.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An image recording apparatus comprising:

a heat-developing section for heat-developing a latent image formed on a photo/heat-sensitive material sheet in which antistatic agent is added; and conveying rollers made of resin for conveying the photo/heat-sensitive material sheet along a sheet feeding path including at least the heat-developing section.

* * * * *